US006249420B1

(12) United States Patent
Roos

(10) Patent No.: US 6,249,420 B1
(45) Date of Patent: Jun. 19, 2001

(54) METHOD OF ARRANGING SEVERAL RELAY FUNCTIONS AND A MULTIPLE RELAY ARRANGEMENT CONFIGURED IN ACCORDANCE WITH THE METHOD

(75) Inventor: Sture Roos, Bergshamra (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/051,108

(22) PCT Filed: Oct. 8, 1996

(86) PCT No.: PCT/SE96/01272

§ 371 Date: Mar. 20, 2000

§ 102(e) Date: Mar. 20, 2000

(87) PCT Pub. No.: WO97/14167

PCT Pub. Date: Apr. 17, 1997

(30) Foreign Application Priority Data

Oct. 9, 1995 (SE) ..... 9503500

(51) Int. Cl.[7] ..... H01H 47/00
(52) U.S. Cl. ..... 361/166; 361/160
(58) Field of Search ..... 361/160, 166, 361/115, 62

(56) References Cited

U.S. PATENT DOCUMENTS 5,264,812 * 11/1993 Tomono et al. ..... 335/78
5,712,608 * 1/1998 Shimomura et al. ..... 335/60

FOREIGN PATENT DOCUMENTS

| | | | |
|---|---|---|---|
| 46807 | 3/1909 | (CH) . | |
| 129 171 | 8/1950 | (SE) | Z13A/22/01 |
| 343 718 | 7/1968 | (SE) | H01H/50/16 |
| 359 194 | 5/1971 | (SE) | H01H/51/28 |
| WO 94/03914 | 2/1994 | (WO) | H01H/51/24 |

* cited by examiner

*Primary Examiner*—Stephen W. Jackson
(74) *Attorney, Agent, or Firm*—Burns, Doane, Swecker & Mathis, L.L.P.

(57) ABSTRACT

A multiple relay arrangement comprises a common fixed part having permanent magnets, a common movable part having permanent magnets, and fixed coils having magnetically actuable movable cores connected to a respective contact means. To establish an electrical contact through the coupling means of the multiple relay arrangement, current is passed through the coil in one direction and through the remaining coils in the opposite direction. In the contact making state, the core will be repelled by the permanent magnet on the fixed part and attracted by the permanent magnet on the movable part. The coupling means connected to the core can then be used to connect together telecommunications conductors for instance. Remaining cores are attracted by the fixed permanent magnets and not moved, although the movable part will be moved away from the fixed part by virtue of the repulsion force acting between the cores and the magnets.

5 Claims, 2 Drawing Sheets

METHOD OF ARRANGING SEVERAL RELAY FUNCTIONS AND A MULTIPLE RELAY ARRANGEMENT CONFIGURED IN ACCORDANCE WITH THE METHOD

FIELD OF THE INVENTION

The present invention relates to a method of arranging several relay functions and also to a multiple relay arrangement configured in accordance with the method. So-called multiple relays are used in many fields. One common field of use is related to telecommunications equipment, in which such relays are used in large numbers for connecting and disconnecting pairs of telephone lines, for instance.

DESCRIPTION OF THE BACKGROUND ART

Electromechanical components are still used in the field of telecommunications, and also in other fields, often in the form of relays, selector switches and like components. Relays can often have multiple functions, for instance test access functions for line interfaces in a digital telephone station. These access functions may be of a multiple type where a plurality of relays having mutually the same function are mounted on a circuit board. A large number of electromagnets are often used in the provision of these multiple functions, each of the electromagnets acting on a spring unit or the like. In constructions in which several relays are collected on a unit, only the force from the electromagnet or the electromagnets where an effect is desired is used, said magnets often being only used one at a time. The functions often involve driving only a few function initiating devices from many such devices and the large number of electromagnets included is unnecessarily large, since each electromagnet is sufficiently strong in itself to carry out a function. Since electromagnets with magnets and coils require space and each incurs an individual cost, it is important that the electromagnets have the smallest possible size and are inexpensive. Patent Publications SE 129 171, 343 718, 359 194 and CH 46807 disclose multiple relays for telecommunications applications that include permanent magnets which are each solely effective in making or breaking an electric contact.

DISCLOSURE OF THE INVENTION

With the intention of lowering the cost of providing a so-called multiple relay, there is provided in accordance with the invention a multiple relay arrangement that includes a common fixed part that carries several permanent magnets, a common movable part that carries several permanent magnets, and several fixed coils which are disposed between the common fixed part and the common movable part and which have magnetic-force actuable and displaceable cores connected with electrical connection elements. When each of the coils carries current, the cores that are actuable by magnetic forces will either move to a new position or be held in their present position at that point in time, depending on the direction in which current flows through the coil and the polarity of the permanent magnets. When wishing to make electrical contact through an electric contact means on the multiple relay arrangement, the coil is connected so that current will flow therethrough in one direction appropriate thereto and remaining coils are connected so that current will flow in another direction, wherewith all cores will be magnetized. In the contact making position, the core will be repelled by the permanent magnet on the fixed part and attracted by the permanent magnet on the movable part during its movement. Telecommunications conductors, for instance, can then be mutually connected together to the contact means connected to the movable cores. Remaining cores are attracted and held by the fixed permanent magnets, i.e. do not move, whereas the movable part connected to permanent magnets will be actuated and moved away from the fixed part by the repulsion forces acting between the now fixed cores and the permanent magnets of the movable part. All magnetic forces coact to move the core which is movable in this case with the repelling force and attraction force for the electric contact making function and displacement of the movable part with permanent magnets and with attraction forces for the excluded switching functions but with repelling forces for displacing the movable part with the permanent magnets and the core connected to this part.

DETAILED DESCRIPTION OF A PREFERRED EMBODIMENT

Figure 1:
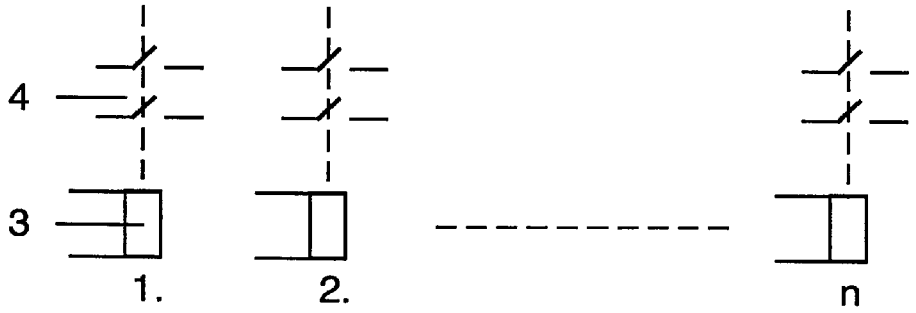
FIG. 1 shows relays arranged in a row in accordance with a known technique.

FIG. 1 illustrates a known technique in which a plurality of relays 1, 2 . . . n are arranged in a row in a multiple relay. Each coil 3 is intended to drive a coupling means 4 having its own spring group, the force required in this regard being represented by the force F. Each coil is capable of generating this force, and the force actually available is n×F, where n is the number of coils present, although only the force F is actually required to open or close the switch.

Figure 2:
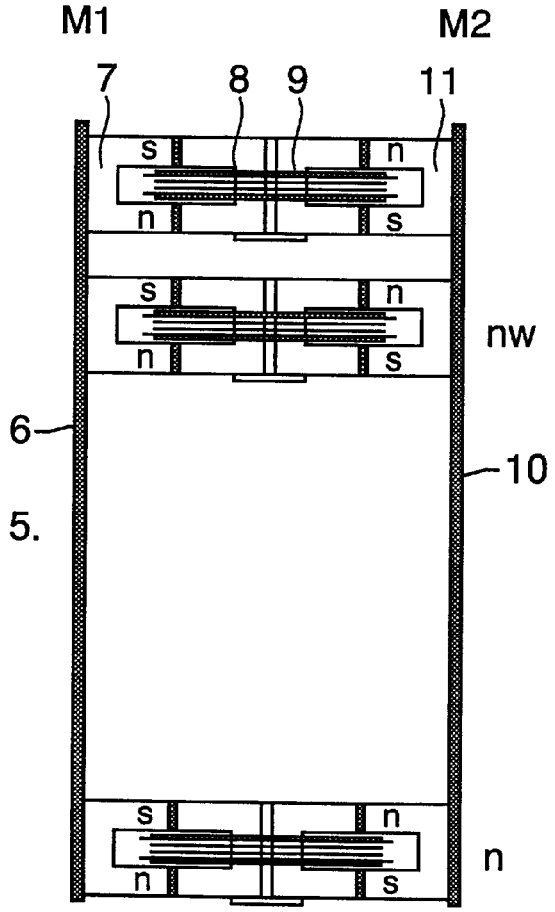
FIG. 2 illustrates a multiple relay arrangement according to the invention, without contact means.

According to the present invention, several functions have been incorporated in a single unit. In this regard, a multiple relay device 5 includes a common fixed part 6 which can be provided with n number of permanent magnets 7, n numbers of movable cores 8, each of which is able to move in relation to a fixed coil 9 connected, e.g., to the fixed part 6, and a common movable part 10 which is provided with n number of permanent magnets 11; see FIG. 2 in this regard (n=. . . 5, 6, 7 . . . 10–40 . . . ). The permanent magnets provide a definable so-called home position in which no current is supplied to the circuit. This can be achieved without requiring the use of counter-springs. In certain applications, the permanent magnets can be replaced with electromagnets. The fixed side 6 (M1) having n number of permanent magnets 7 and the movable side 10 (M2) having n number of permanent magnets 11 may be polarized in accordance with FIG. 2, wherein all air gaps between cores and magnets will be closed when no current is supplied to the coils.

Figure 3:
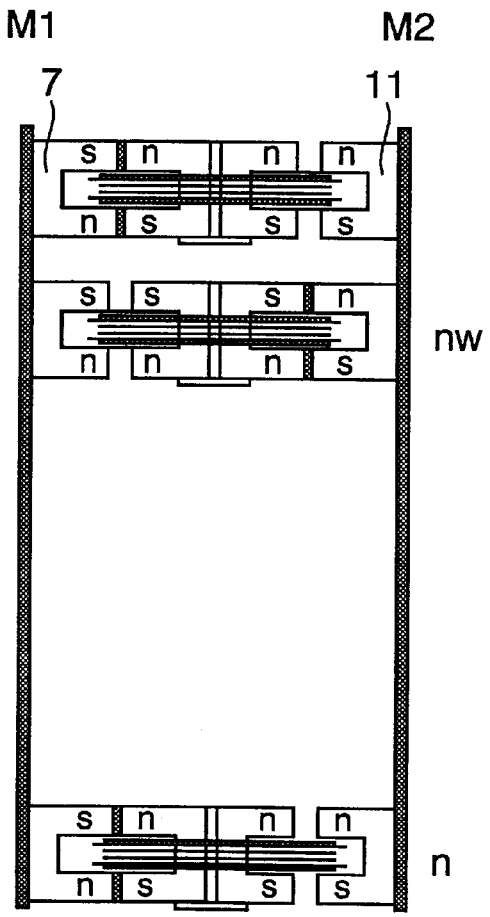
FIG. 3 illustrates an actuated multiple relay arrangement according to the invention without contact means.

When current is supplied to the circuit containing the coils such as to polarize the cores in accordance with FIG. 3, all cores will be attracted by M1 with the exception of the core nw, which is now attracted by M2. The core nw will repel M1 and all other cores will repel M2, therewith using force from all cores. The attraction force between the core nw and M2 is very strong by virtue of the fact that in principle the air gap may be zero. Thus, one or more cores can be caused to coact with respective contact elements with the aid of all other cores, by reversing the polarity of one or more coils.

When the current supply is broken, all circuits are assisted in returning the core/cores to its/their home positions. Because the cores in the non-activated circuits do not move, no friction losses are experienced there.

Figure 4:
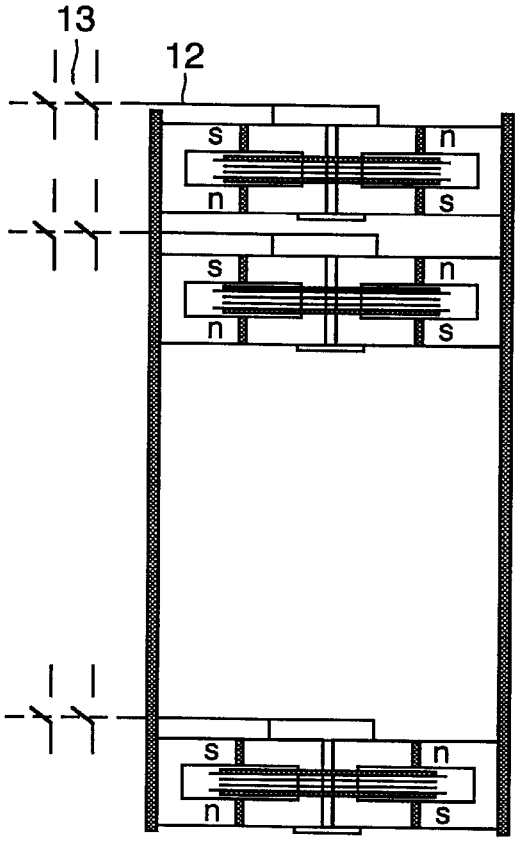
FIG. 4 illustrates an inventive multiple relay arrangement with contact means.
Figure 5:
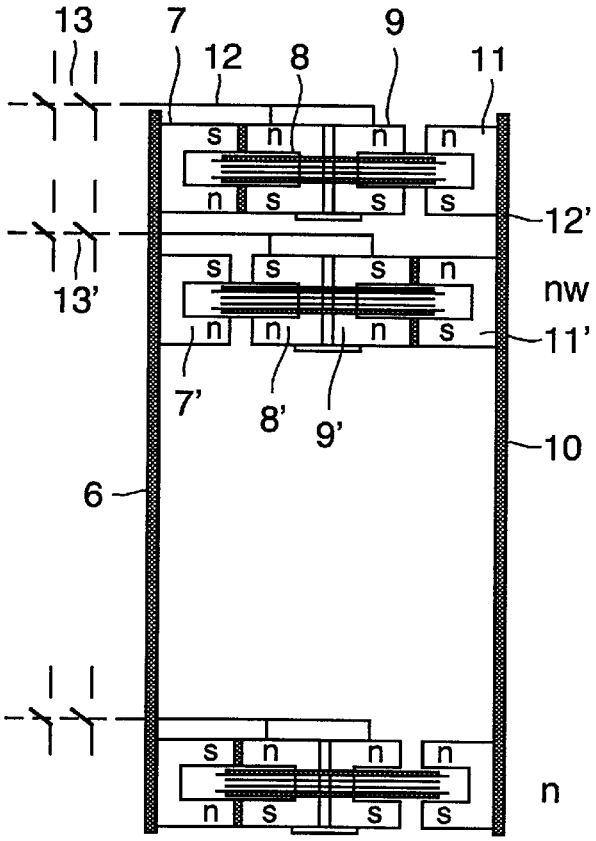
FIG. 5 illustrates an actuated inventive multiple relay arrangement with an activated contact means.

FIG. 4 illustrates an inventive multiple relay at rest and connected to contact means 12 with open contacts 13 for the connection or disconnection of conductors. FIG. 5 shows the nw coil 9' connected to an electric circuit and remaining coils to another circuit that is oppositely directed to the former circuit, the core 9' having therewith been moved to the right in the Figure and having broken the supply of current 13' through its coaction with the contact means 12'. The core 8' has been moved by the repulsion force of the fixed permanent magnet 7' and the attraction force of the movable permanent magnet 11'. Remaining cores 8 have not been moved, since they are attracted by the fixed magnets and repelled by the movable permanent magnets 11. The combined magnetic forces have moved the movable part 10 and the core 8' and the contact device 12' connected thereto. The fixed magnets 7 may be mounted in a row on a fixed frame 6, to which the coils 9 may also be connected. The movable magnets 11 may be arranged in a row on a frame 10 which is movable in relation to the fixed frame.

The cores 8 and the movable part 10 can be caused to move by directing current to the fixed coils 9. The core or cores that moves/move will initiate the circuit closing function, whereas the cores that do not move will not effect a switching function, i.e. the circuits will remain open but the repulsion force acting between these cores and the movable magnets will contribute in moving the contacts in the contact means. A magnetic force n×f from all electromagnets with a magnetic force f is required to close the current in a switch, where f can be elected to be much lower than a corresponding force F for individual electromagnetically controlled contact devices.

What is claimed is:

1. A multiple relay arrangement having a plurality of relay functions for use, e.g., in telecommunications equipment for connecting or disconnecting pairs of telephone lines, characterized in that a plurality of movable cores (8) are arranged to act between a plurality of commonly arranged fixed magnets (7) and a plurality of commonly arranged movable magnets (11); in that each core (8) has a fixed coil (9) which when current passes therethrough functions to move said core (8) together with the movable magnet (11) away from a corresponding fixed magnet (7), or causes the core (8) to remain at said corresponding fixed magnet (7) and move a corresponding movable magnet (11), wherein a contact means (12) is connected to the core for the connection or disconnection of a conductor.

2. A multiple relay arrangement according to claim 1, characterized in that the fixed magnets (7) are disposed in a row on a fixed frame (6) to which the coils (9) are also connected; in that the movable magnets (11) are disposed in a row on a frame (10) which is movable in relation to the fixed frame (6); and in that each core is intended to act between a magnet (7) on the fixed frame (6) and a magnet (11) on the movable frame (10).

3. A multiple relay arrangement according to claim 1, characterized in that the magnets (7, 11) are permanent magnets.

4. A multiple relay arrangement according to claim 1, characterized in that the magnets (7, 11) are electromagnets.

5. A method of arranging several relay functions for use in telecommunication equipment, for instance, for connecting or disconnecting pairs of telephone lines, characterized by arranging a plurality of movable cores for action between a plurality of fixed magnets and a plurality of commonly disposed movable magnets; supplying electric current to a fixed coil of each movable core such as to cause the core either to be displaced together with the movable magnet from the corresponding fixed magnet to a displaced position in relation thereto or for causing the core to remain at said corresponding fixed magnet and displace said corresponding movable magnet, wherein a contact means is connected to the core for the connection or disconnection of a conductor.

* * * * *